US008673088B1

(12) United States Patent
Suiter, II

(10) Patent No.: US 8,673,088 B1
(45) Date of Patent: Mar. 18, 2014

(54) FOAM DISPENSING DEVICE

(76) Inventor: Thomas P. Suiter, II, Littleton, CO (US)

( * ) Notice: Subject to any disclaimer, the term of this patent is extended or adjusted under 35 U.S.C. 154(b) by 671 days.

(21) Appl. No.: 12/885,310

(22) Filed: Sep. 17, 2010

Related U.S. Application Data

(60) Provisional application No. 61/307,435, filed on Feb. 23, 2010.

(51) Int. Cl.
*B08B 9/027* (2006.01)

(52) U.S. Cl.
USPC ..... 134/22.11; 134/22.14; 134/24; 134/36

(58) Field of Classification Search
USPC ..... 134/22.1, 22.11, 22.13, 22.14, 24, 26, 134/27, 29, 36
See application file for complete search history.

(56) References Cited

U.S. PATENT DOCUMENTS

| | | | | |
|---|---|---|---|---|
| 3,741,807 | A * | 6/1973 | Horne | 134/24 |
| 3,880,176 | A | 4/1975 | Horne | |
| 4,082,567 | A | 4/1978 | Conklin | |
| 4,981,524 | A * | 1/1991 | Waite | 134/24 |
| 5,165,434 | A | 11/1992 | Tobiason | |
| 5,361,512 | A | 11/1994 | Tobiason | |
| 5,735,955 | A | 4/1998 | Monaghan | |
| RE37,732 | E | 6/2002 | Newton | |
| 6,841,518 | B2 | 1/2005 | Malavenda | |

* cited by examiner

*Primary Examiner* — Saeed T Chaudhry
(74) *Attorney, Agent, or Firm* — Leyendecker and Lemire, LLC

(57) ABSTRACT

A device for combining multiple components into a foam mixture and dispensing the foam mixture into a pipe is described. The multiple components are combined immediately prior to dispensing, which maximizes activity for labile, biologically active components whose degradation accelerates upon combining components. Embodiments of the device are relatively light weight and adapted to removably couple to sewer cleaning vehicles.

11 Claims, 3 Drawing Sheets

FOAM DISPENSING DEVICE

The present application claims priority to and incorporates by reference U.S. provisional Patent Application No. 61/307,435, filed 23 Feb. 2010, having the same inventor as the present application and the title "ROOTICIDE MIXING AND FOAM DISPENSING SYSTEM."

FIELD OF THE INVENTION

The present invention relates generally to devices and systems adapted to make and dispense foam.

BACKGROUND

Foams containing compounds that kill roots and/or retard root growth are used to mitigate or prevent blockage of sewer lines by plant roots. Aqueous suspensions, solutions, and mixtures containing the rooticide sodium methyldithiocarbamate (metam-sodium, hereafter referred to as SMDC) are often used to treat sewer lines because such treatment generally does not kill a plant whose roots are eradicated by the SMDC. However, SMDC degrades relatively rapidly at working concentrations in water, a half-life of dilute working concentrations of aqueous SMDC being about 28 minutes. Aqueous stock solutions of SMDC, which are typically about 30% SMDC by weight in water, are relatively stable because the SMDC is not fully solvated by the water.

Because SMDC is a very effective rooticide, aqueous SMDC at working concentrations can maintain effective potency for many hours, and may remain potent for about a day, despite the lability of relatively dilute SMDC in water. A great deal of SMDC is nevertheless wasted because of its degradation in water, and batches of degraded aqueous SMDC are frequently discarded. An alternative to mixing batches of SMDC in water in anticipation of delivering most or all of the entire batch within a few hours is therefore highly desirable.

Sewer cleaning vehicles are typically equipped with beneficial components that are advantageous for delivering foam into sewer lines. The beneficial components include large water tanks, long hoses with jet nozzles adapted to travel into and through sewer lines, and air compressors. However, while the large water tanks are useful for making foam, the aforementioned problem with creating large batches of SMDC at working concentrations creates a serious drawback to using sewer cleaning vehicles for making and delivering rooticidal foam. Moreover, sewer cleaning vehicles can be difficult to modify for making and delivering foam because the vehicles are typically packed tight with sewer cleaning components, leaving little space for adding or rearranging components in order to facilitate foam making and delivery.

DETAILED DESCRIPTION

Figure 1:
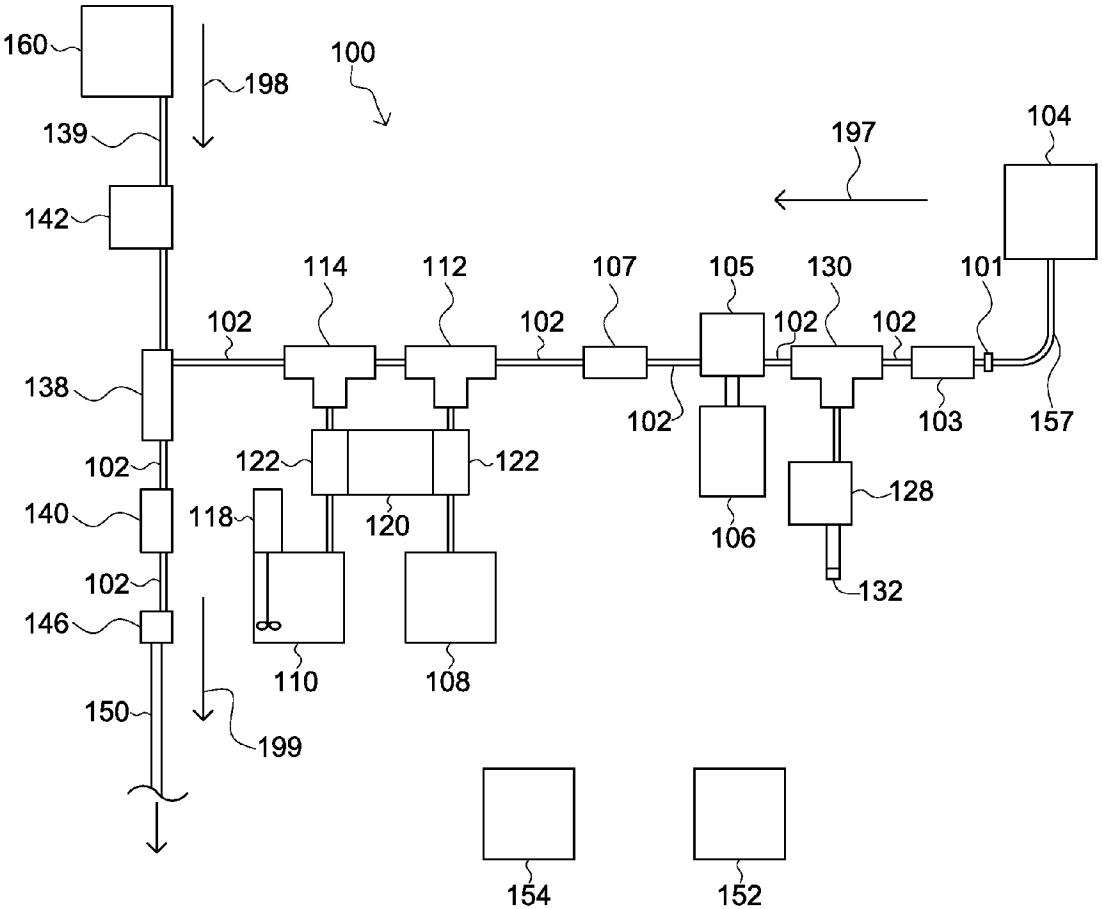
FIG. 1 is a schematic view of a foam dispensing device according to one embodiment of the present invention.

Embodiments of the present invention comprise a foam dispensing device adapted to make and deliver an aqueous foam containing a rooticide. The rooticide may be a water labile rooticide such as, but not limited to, SMDC. The rooticidal foam is typically dispensed into sewer pipes to kill roots that invade the sewer pipes. Foam is created by entraining an aqueous preparation with air, and the foam is pumped into the pipes to kill or retard growth of plant roots in the pipes. The water labile rooticide is diluted with water immediately prior to being added to the foam, which is then dispensed into the sewer pipes. Accordingly, the rooticide is dispensed with the foam before the rooticide suffers substantial degradation; rooticide potency is thus maintained. In addition, no waste results from premixed batches of rooticide in water that must be discarded because of degradation of water labile ingredients over time.

Foams for treating or preventing root growth in sewer pipes often contain particulate matter such as 2,6-dichlorobenzonitrile (dichlobenil) powder suspended in the foam, and embodiments of the foam dispensing device further comprise mixing means adapted to keep particulate solids suspended in fluid. Dichlobenil is an inhibitor of root growth. In some embodiments, dichlobenil powder is combined with water in a tank equipped with mixing means, the mixing means aiding in suspension of the dichlobenil in the water.

The dichlobenil/water suspension is combined with SMDC and the dichlobenil/water/SMDC mixture infused with air immediately before being dispensed. The resulting rooticidal foam is typically dispensed into a sewer line under positive pressure through a hose or line.

Embodiments of the foam dispensing device are portable, the devices being relatively lightweight, compact, and small. Some embodiments have a dry weight of preferably less than 600 pounds, more preferably less than 400 pounds, and most preferably less than 200 pounds. In addition, embodiments of the foam dispensing device include an enclosure within which most components of the foam dispensing device reside. A volume contained within the enclosure is preferably less than 18 cubic feet, more preferably less than 15 cubic feet, still more preferably less than 12 cubic feet, and most preferably less than 10 cubic feet.

Many embodiments are adapted to be detachably coupled to a receiver hitch and can be transported by almost any vehicle equipped with a class II or greater receiver hitch. Alternatively, some embodiments may be directly mounted on or to a vehicle without using a receiver hitch.

Accordingly, embodiments of foam dispensing devices can enable most common sewer cleaning vehicles to dispense foam by connecting the foam dispensing device to a sewer cleaning vehicle via the truck's receiver hitch, or otherwise mounting the foam dispensing device to the sewer cleaning vehicle. Moreover, the device's light weight and portability enable transport and delivery of the device using a vehicle such as a light truck or van. Two men can typically install the first embodiment foam dispensing device on a pickup truck receiver hitch, or load the device into a pickup bed for transport. Similarly, two men can typically mount the device on a sewer cleaning vehicle receiver hitch for dispensing rooticidal foam. Embodiments of the foam dispensing device can be operationally connected to and used with a sewer cleaning vehicle while residing in close proximity to the sewer cleaning vehicle, but not structurally coupled to or mounted thereupon. The foam dispensing device proximate the sewer cleaning vehicle may remain in or on a pickup truck or other vehicle while operationally coupled to and used with the sewer cleaning vehicle.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or," as used in this specification and appended claims, is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled," as used in this specification and appended claims, refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled. The terms "operationally coupled" and "operationally connected," as used in this specification and appended claims, refer to a functional connection between identified elements, components, or objects, such that an operation or function of an identified element, component, or object, results in a change in another identified element, component, or object. For instance, where a where a control pad is operationally coupled to a device controller, the control pad and device controller are connected in a way that allows transmission or exchange of information between the control pad and the device controller. The control pad and device controller may or may not have a physical connection; a wireless means of control or exchange of information between the two components qualifies as an operational coupling. Similarly, where an air compressor is operationally coupled to a gas injector, the air compressor and air inlet are in fluid communication such that compressed air from the air compressor is or can be received by the gas injector.

The terms "structurally coupled," "structurally connected", "structural connection," and similar terms, as used in this specification and appended claims, refer to a robust physical connection between identified elements, components, or objects, through which substantial structural support is provided. For instance, where a foam dispensing device is coupled to a vehicle through a receiver hitch, the connection through the receiver hitch is a "structural connection." Similarly, where a foam dispensing device is bolted to a vehicle, the foam dispensing device is "structurally connected" to the vehicle through the bolt connections. Conversely, where a foam dispensing device is coupled to a vehicle through a connection between a main fluid path of the foam dispensing device and a hose on the vehicle, the connection is not a structural connection. Similarly, where a foam dispensing device is coupled to a vehicle through a connection between the vehicle's compressed air line and the foam dispensing device's gas injector, the connection is not a structural connection.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The terms "rooticide" or "rooticidal," as used in this specification and appended claims, refer to a chemical composition adapted to kill plant roots. Rooticides may or may not be systemically toxic to a plant whose roots the rooticide kills. SMDC is a rooticide that specifically targets root tissue but is not a systemic herbicide, and therefore generally does not kill trees, shrubs, or other plants whose roots are treated with SMDC.

The terms "sewer cleaning vehicle" or "sewer cleaning vehicles," as used in this specification and appended claims, refer to relatively large vehicles used by commercial sewer cleaners. Sewer cleaning vehicles typically comprise a hose, the hose being adapted to carry water under relatively high pressure (preferably over 100 psi, more preferably 500 to 2500 psi, and most preferably 1500-2000 psi) into sewer lines. Sewer cleaning vehicles typically include about 500 feet of the hose installed on a large reel. The hose is frequently equipped with a jet nozzle adapted to propel the jet nozzle (and hence the hose to which it is attached) into a sewer line when the water under relatively high pressure exits the jet nozzle, thereby providing jet force that propels the jet nozzle. Sewer cleaning vehicles include large water tanks, the large water tanks sometimes having a capacity of about 1000 gallons, and almost always having a capacity over 100 gallons. Examples of sewer cleaning vehicles include, but are not limited to, Vactor® sewer cleaning trucks (including 2100 Plus, 2100 Series Fan, 2100 Series PD, and 2103 models), vehicles and trailers from Sewer Equipment of America® (including model 800-HPRTV, 800-HPR, 800-H, 800-HF, 747-TK and 800 truck jets, and model 747-FR2000TV, 747-FR2000, and 747-4000 trailer jets), and sewer cleaning vehicles from VAC-CON®.

The terms "working concentration" and "working concentrations," as used in this specification and appended claims, refers to solutions or mixtures of rooticide that include less than 10% rooticide by weight. A working solution is preferably less than 10% by weight rooticide, more preferably less than 5% rooticide by weight, and most preferably about 1.5% rooticide by weight. Mixtures include suspensions, emulsions, and heterogeneous and homogeneous mixtures.

The terms "stock solution" and "stock solutions," refer to solutions or mixtures of rooticide that comprise greater than 10% rooticide by weight.

The terms "removable," "removably coupled," "readily removable," "detachable," "detachably coupled," and similar terms, as used in this specification and appended claims, refer to objects or structures that can be uncoupled from an adjoining object or structure with relative ease, i.e. non-destructively and without complicated or time consuming process, and can also be readily reattached or coupled to the previously adjoining object or structure. Where the term refers to a foam dispensing device that is "detachably coupled" to a vehicle, the foam dispensing device can be removed from the vehicle by disconnecting one or two main structural connections, rather than uninstalling components of the foam dispensing device individually or in multiple groups of a plurality of components. A foam dispensing device that is structurally coupled to a sewer cleaning vehicle through a receiver hitch is detachably coupled to the truck.

The term "dry weight" and similar terms, as used in this specification and appended claims, refer to weight of a foam dispensing device in which no foam or deliverable liquids reside. Deliverable liquids in include water, solutions or liquid mixtures (including suspensions and emulsions) of rooticide, SMDC, dichlobenil, or other foam ingredients in liquid or foam state. Deliverable liquids do not include liquids such as lubricants, oils, or coolants whose primary function is to enable pumps, valves, compressors, or similar components to operate.

A First Embodiment Rooticide Foam Dispensing Device

Figure 2:
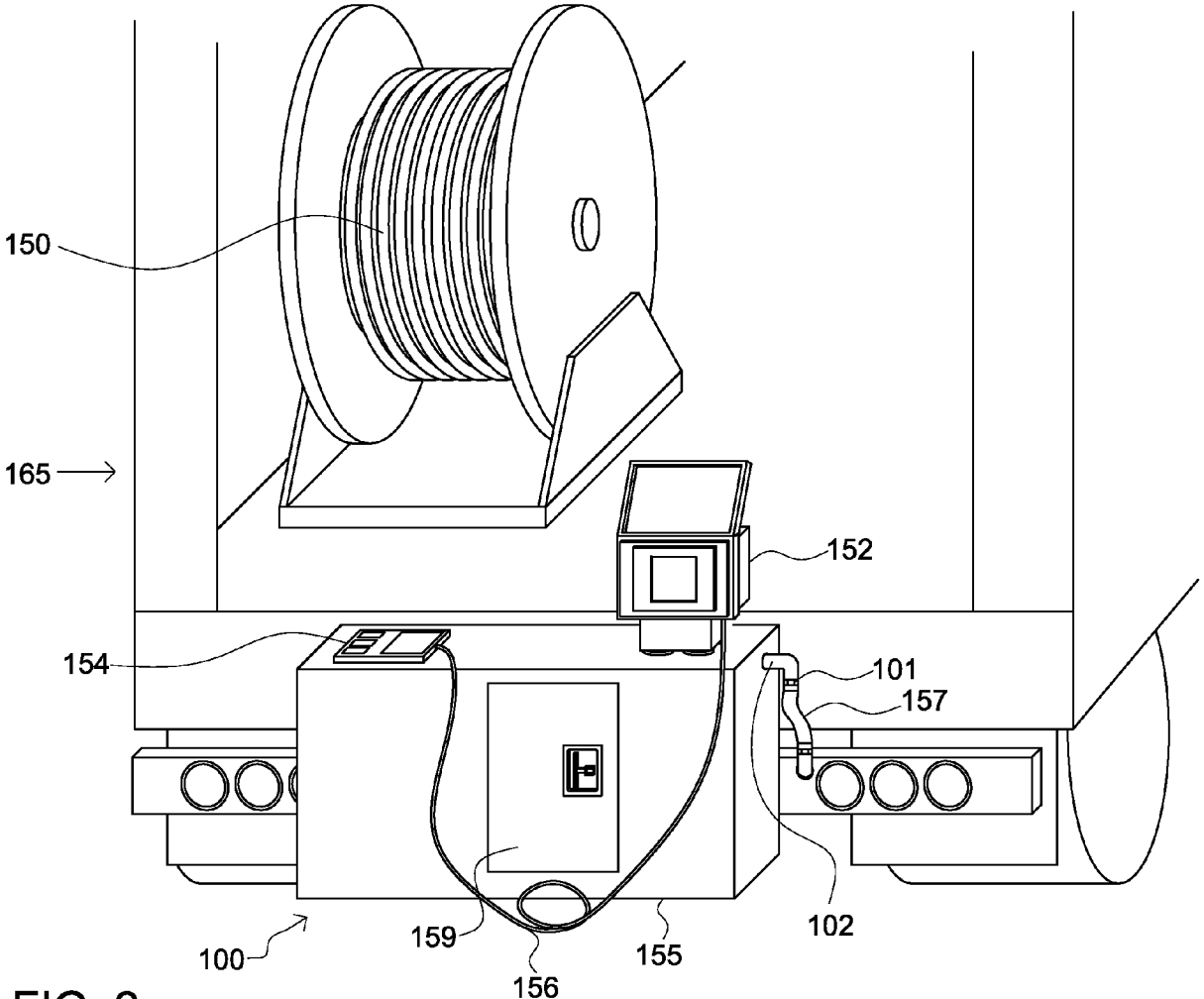
FIG. 2 is perspective view of a foam dispensing device mounted on a sewer cleaning truck, according to one embodiment of the present invention.
Figure 3:
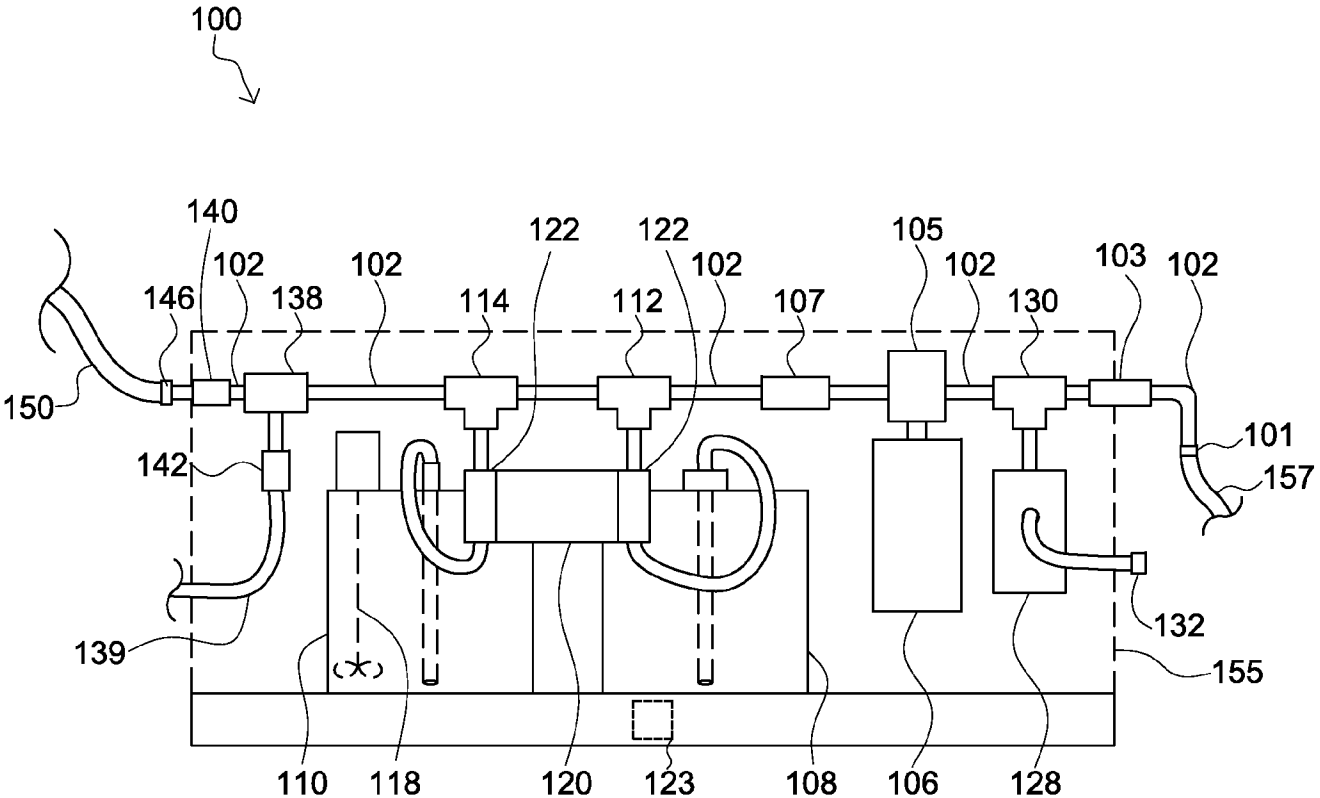
FIG. 3 is a pan view of a foam dispensing device according to one embodiment of the present invention.

A first embodiment foam dispensing device 100 is illustrated in FIGS. 1-3. A schematic representation is illustrated in FIG. 1. The foam dispensing device is illustrated mounted on a sewer cleaning vehicle 165 in FIG. 2, with an enclosure 155 obscuring most device components. The sewer cleaning vehicle illustrated in FIG. 2 is a sewer cleaning truck from Sewer Equipment of America®. FIG. 3 illustrates the foam dispensing device with the enclosure 155 removed. An outline of the enclosure 155 is indicated in FIG. 3 by a broken line.

The foam dispensing device 100 comprises a main fluid path 102 through which fluid flows through the device. The main fluid path comprises stainless steel pipe and fittings having inside diameters of 0.5 inch or 0.75 inch. In some embodiments, the main fluid path comprises other size metal or plastic pipes or lines. The main fluid path may also include flexible lines or hoses. A water tank 104 provides water to the foam dispensing device 100, the water tank having a capacity of about 1000 gallons and residing on a vehicle such as, but not limited to, a sewer cleaning vehicle 165. The foam dispensing device 100 further comprises an inlet coupler 101 and a first back flow preventer 103. The main fluid path 102 is adapted to receive water from the water tank through an inlet line 157 connected to the main fluid path at the inlet coupler 101. The first back flow preventer prevents liquid from flowing back toward the water tank 104. The first back flow preventer, as well as other back flow preventers of the first embodiment foam delivery device, comprises a ¾ inch stainless steel and Viton® check valve from Check-All®, West Des Moines, Iowa.

A main pump 105, powered by a motor 106, pumps water through the main fluid path 102. The main pump of the first embodiment is model PA1001 vane pump from Fuid-O-Tech International®, Plantsville, Conn., and the motor is a variable speed ¾ horsepower electric motor that operates from 0 to 2400 rpm. Other embodiments include main pumps such as, but not limited to, a model 4101N-A four roller pump from HYPRO®, New Brighton, Minn. The main pump 105 delivers water through the main fluid path at a flow rate preferably between 1.0 and 20 gallons per minute (gpm), more preferably between 2.0 and 10 gpm, and most preferably about 4.5 gpm. A pressure sensor 107 monitors pressure in the main fluid path 102 just downstream from the main pump 105.

The foam dispensing device 100 further comprises a first additive tank 108 and a second additive tank 110. The first and second additive tanks contain foam ingredients that are added to the main fluid path 102 through a first tee 112 and a second tee 114, respectively. The first additive tank 108 has a capacity of about 5 gallons, and contains a Vaporooter® proprietary SMDC solution from Douglas Products™, Liberty, Mo. In some embodiments, the Vaporooter® proprietary SMDC solution contains 30% SMDC by weight in water, as well as multiple surfactants, the multiple surfactants including five different surfactants. Some or all of the multiple surfactants act as foaming agents, and some or all of the multiple surfactants function as grease cutting agents. Embodiments of the foam dispensing device include first additive tanks that preferably have a volume of at least one quart, more preferably between about 2 quarts and 12 gallons, and most preferably about 5 gallons.

The second additive tank 110 has a capacity of about 12 gallons and contains a proprietary mixture of dichlobenil particles suspended in a mixing fluid. The mixing fluid in the second additive tank is aqueous media that is greater than 50% water. A mixer 118 stirs the proprietary mixture in order to induce or maintain suspension of the dichlobenil particles in the aqueous media. The mixer of the first embodiment is a model 6000 stirrer from Arrow Engineering, Hillside, Pa. The mixer provides sustained mixing that helps keep the dichlobenil suspended in aqueous media. In other embodiments, mixers include mixing means adapted to suspend particulate matter in fluid. The mixing means include, but are not limited to, devices adapted to mix, agitate, vibrate, sonicate, ultrasonicate, stir, shake, rotate, invert, or recirculate the second additive tank or contents thereof. Embodiments of the foam dispensing device include second additive tanks that preferably have a volume of at least one quart, more preferably between about 2 gallons and 15 gallons, and most preferably about 10 gallons.

An additive pump 120, fitted with two pump heads 122, delivers foam ingredients from the first additive tank 108 and the second additive tank 110 to the main fluid path 102. The additive pump 120 of the first embodiment comprises a model Q2V pump drive module from Fluid Metering, Inc.™, Syosset, N.Y., fitted with two model Q3CKC pump heads 122, also from Fluid Metering, Inc.

The device 100 further comprises a wash pump 128 that connects to the main fluid path 102 through a wash tee 130. The wash pump enables flushing a liquid from the water tank 102, through the first back flow preventer 103 and wash tee 130, and then to a waste outlet 132, rather than the liquid flowing to the main fluid pump and continuing through the main fluid path 102 to a gas injector 138.

The foam dispensing device 100 further comprises the gas injector 138, through which gas is introduced to the main fluid path 102 to create a foam when the main fluid path contains water and a surfactant or foaming agent. The gas injector 138 of the first embodiment is a model 50580 or model 13340 siphon injector from Spraying Systems Co.®, Wheaton, Ill., and the gas is air. The gas is delivered through an air line 139 from an air compressor 160 to foam dispensing device 100. The air is delivered under positive pressure, the positive pressure being preferably between 60 and 150 psi, more preferably between 80 and 120 psi, and most preferably about 90 psi. The air compressor is typically a component of the sewer cleaning vehicle. The air compressor therefore typically remains on the sewer cleaning vehicle when the foam dispensing device 100 is removed from the vehicle. About 10-20 cubic feet per minute of air is typically injected through the gas injector at the positive pressure described above. The foam dispensing device further comprises an air switch 142 adapted to interrupt airflow between the compressor 160 and the gas injector 138.

Downstream from the gas injector 138, a fluid in the main fluid path 102 typically changes from a liquid to the foam, the change occurring through introduction of air into the liquid. The liquid typically comprises water, dichlobenil, SMDC, and multiple surfactants. The foam is typically dispensed from the foam dispensing device 100 and enters a foam delivery line 150, the foam delivery line being connected to the foam dispensing device 100 through an outlet coupler 146.

The outlet coupler also serves as a foam outlet through which foam exits the foam dispensing device and enters the foam delivery line. The foam is dispensed through the foam outlet at a rate preferably between 30 and 120 gallons per minute (gpm), more preferably between 45 and 90 gpm, and most preferably about 65 gpm.

The foam delivery line 150 often comprises a hose, the hose typically, but not necessarily, having an inside diameter of about one inch. The hose is preferably at least 50 feet long, more preferably between 100 and 1000 feet long, and most preferably about 500 feet long. The foam delivery line may inter a sewer pipe for delivery of the foam from the fluid delivery device. A second back flow preventer 140 prevents foam or other fluid from the foam delivery line from entering the foam dispensing device 100, should pressure build in the foam delivery line. The second back flow preventer comprises a ¾ inch stainless steel and Viton® Check-All® check valve.

The foam delivery device 100 further comprises a device controller 152 and a control pad 154. The control pad is operationally coupled to the device controller and provides an interface between a user and the device controller; information is exchanged between the control pad and the device controller. Operational coupling between the device controller and control pad may be wired or wireless, and in either case permits the user to control the foam delivery device from a location distal to the enclosure 155. Thus the user can operate the foam dispensing device while standing at a front of the sewer cleaning vehicle, where the foam delivery line sometimes resides on a reel. The user is thus positioned to concurrently observe or control the foam delivery line and the foam delivery device. The device controller is a programmable logic control module. In some embodiments, a general purpose computer can be used as a device controller.

The device controller 154 is operationally coupled to numerous device components, including the wash pump 128, the motor 106, the mixer 118, the additive pump 120, and the air switch 142. Accordingly, the user can control these device components through the device controller. Similarly, the device controller 100 is operationally coupled to the pressure transducer 107, allowing the user to monitor device pressure.

FIG. 2 illustrates the first embodiment foam dispensing device 100 mounted on a back end of a sewer cleaning vehicle 165, the sewer cleaning vehicle being a truck. The foam dispensing device is detachably coupled to the truck through a receiver hitch. The receiver hitch is not visible in FIG. 2. The foam dispensing device comprises a receiver hitch tube 123 visible in FIG. 3. The receiver hitch tube 123 is adapted to receive a two inch shank.

As best viewed in FIG. 2, an enclosure 155 surrounds and protects components of the foam dispensing device 100 contained within the enclosure. An access door 159 provides a portal in the enclosure though which additive tanks or other device components can be accessed and removed or replaced. In some embodiments, a top of the enclosure is also adapted to open readily in order to provide access to components housed within. The enclosure of the first embodiment consists primarily of stainless steel. In some embodiments the enclosure consists primarily of aluminum alloy. Embodiments of the enclosure include other substantially rigid material such as, but not limited to, metal, metal alloys, composites, high impact plastics, polymers, or thermoplastics. Composites include, but are not limited to, carbon or glass fibers imbedded in resin. An end portion of the main fluid path 102 extends outside the enclosure, where the inlet coupler 101 connects to the inlet line 157. Water from the water tank 104 is delivered to the foam dispensing device through the inlet line.

The device controller 152 and control pad 154 are shown resting on the enclosure 155 in FIG. 2, with the control pad being operationally coupled to the device controller through a control cable 156. The control cable 156 of the first embodiment foam dispensing device 100 is about 10 feet long. Some embodiments comprise control cables that are 25 feet long or longer, providing an operator with a relatively large area distal to the enclosure from which he or she can control the foam dispensing device. Cables that operationally couple the device controller to components contained within the enclosure are not shown. Both the device controller and the control pad are merely resting on the enclosure, and are not securely installed thereon. In some embodiments, the device controller comprises magnets adapted to secure the device controller to ferromagnetic structures.

The foam delivery device 100 occupies a relatively small volume and is relatively light weight, which contributes to the device's portability and relative ease of handling by two men. A volume residing within the enclosure 155 of the first embodiment foam deliver device 100 is about 9.2 cubic feet, the enclosure having a longest dimension of about 42 inches, a second dimension (height) of about 21 inches, and a third dimension (depth) of about 18 inches. The first embodiment foam delivery device weighs about 160 pounds dry and about 302 pounds with the first additive tank 108 and the second additive tank 110 full to capacity with aqueous liquid.

As illustrated in FIG. 1, a first arrow 197 shows a direction of aqueous liquid flow within the main fluid path 102 from the inlet coupler 101 to the gas injector 138, during foam dispensation. A second arrow 198 shows a direction of gas flow from the compressor 160 to the gas injector 138 during foam dispensation, and a third arrow 199 shows direction of foam flow downstream from the gas injector 138.

Embodiments of the foam dispensing device are "closed" systems that can be operated without exposing users to foam or foam ingredients. Once the foam dispensing device is loaded with ingredients such as SMDC and dichlobenil, additive tanks are tightly closed and the device enclosure is secured shut such that foam making components of the foam dispensing device are isolated within the enclosure, away from device users. The foam dispensing device can then be operationally coupled to a sewer cleaning vehicle without exposing users to foam or foam ingredients.

In some embodiments, the first additive tank comprises an aqueous SMDC and surfactant preparation in a factory sealed 5 gallon vessel. Typically, an empty first additive tank in the foam dispensing device is replaced with the 5 gallon vessel of aqueous SMDC and surfactant, with no pouring, transfer, or mixing of ingredients by personnel required. The 5 gallon vessel is merely placed in the foam dispensing device after removing an empty first additive tank, whereupon the 5 gallon vessel is operationally connected to the main fluid path such that the second pump can pump the aqueous SMDC and surfactant preparation into the main fluid path. The 5 gallon vessel thus becomes a first additive tank. Accordingly, even in the field, the foam dispensing device can be recharged with SMDC without exposing personnel to the SMDC, or to other foam ingredients.

The foam dispensing device is typically primed with water from a sewer cleaning vessel before generation and dispensation of rooticidal foam commences. Similarly, the foam dispensing device can be flushed with water after use, with no need for users to come into contact with foam ingredients or the rooticidal foam. Accordingly, personnel are protected from contact with foam or foam ingredients while priming the foam dispensing device, as the foam is generated and dispensed into a sewer line, and during flushing of the foam dispensing device after use.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A method of dispensing foam comprising:

providing a foam dispensing device including;

a main fluid path, the main fluid path including an inlet and a foam outlet, the inlet being (i) adapted to receive a liquid, and (ii) in fluid communication with the foam outlet;

a first tank operatively coupled to the main fluid path between the inlet and the outlet, and having a volume of at least one quart;

a second tank operatively coupled to the main fluid path between the inlet and the outlet, and having volume of at least one quart;

a first pump configured to pump fluid from the main fluid path to the foam outlet;

a second pump configured to pump fluid to the main fluid path from at least one of the first tank and the second tank; and a gas injector, the gas injector being adapted to inject a gas into the main fluid path;

providing a sewer cleaning vehicle, providing a water tank, the water tank having a capacity of greater than 250 gallons and residing on the sewer cleaning vehicle;

providing a hose, the hose being at least 50 feet long;

dispensing water from the water tank into the main fluid path;

dispensing a fluid from the first tank into the main fluid path;

dispensing a fluid from the second tank into the main fluid path;

injecting gas into the main fluid path; and dispensing foam from the main fluid path into the hose.

2. The method of claim 1, further comprising removing the foam dispensing device from the sewer cleaning vehicle while the water tank remains on the sewer cleaning vehicle.

3. The method of claim 1, further comprising:

providing an air compressor, the air compressor residing on the sewer cleaning vehicle;

delivering air from the air compressor to the gas injector under positive pressure; and delivering foam through the hose into a sewer line.

4. The method of claim 3, wherein the foam dispensing device is detachably coupled to the sewer cleaning vehicle, and further comprises an enclosure, the first tank, the second tank, and the first pump residing within the enclosure, the enclosure enclosing a volume less than 15 cubic feet.

5. The method of claim 3, further comprising providing a receiver hitch, the receiver hitch detachably coupling the foam dispensing device to the sewer cleaning vehicle.

6. The method of claim 5, wherein the foam dispensing device further comprises an enclosure enclosing a volume of less than 18 cubic feet, wherein the first tank, the second tank, the first pump, and the second pump reside within the enclosure volume.

7. The method of claim 6, wherein the foam dispensing device weighs less than 300 pounds dry and weighs less than 442 pounds with both the first tank and the second tank full to capacity with an aqueous liquid.

8. The method of claim 5, wherein the foam dispensing device further comprises a wash pump, the wash pump being configured to pump a fluid through a portion of the main fluid path to a waste outlet without the fluid exiting the foam outlet.

9. The method of claim 5, wherein:

the first tank contains a rooticide; and the method further comprises pumping the rooticide from the first tank to the main fluid path and incorporating the rooticide in the foam delivered into the sewer line.

10. The method of claim 9, wherein the rooticide includes sodium methyldithiocarbamate (SMDC), the SMDC residing in the first tank in a solution or mixture at a concentration of at least 10% SMDC by weight.

11. The method of claim 10, wherein:

the foam dispensing device further comprises a mixer residing in the second tank; and the method further comprises suspending 2,6-dichlorobenzonitrile in water in the second tank and incorporating the 2,6-dichlorobenzonitrile in the foam delivered into the sewer line.

* * * * *